US005238763A

United States Patent [19]

Sullivan et al.

[11] Patent Number: 5,238,763

[45] Date of Patent: Aug. 24, 1993

[54] ELECTROPHOTOGRAPHIC IMAGING MEMBER WITH POLYESTER ADHESIVE LAYER AND POLYCARBONATE ADHESIVE LAYER COMBINATION

[75] Inventors: Donald P. Sullivan, Rochester; Kathleen M. Carmichael, Williamson; Sharon E. Normandin, Macedon, all of N.Y.

[73] Assignee: Xerox Corporation, Stamford, Conn.

[21] Appl. No.: 815,221

[22] Filed: Dec. 31, 1991

[51] Int. Cl.[5] ..... G03G 5/14

[52] U.S. Cl. ..... 430/58; 430/60; 430/63

[58] Field of Search ..... 430/58, 59, 60, 63

[56] References Cited

U.S. PATENT DOCUMENTS

| | | | |
|---|---|---|---|
| 4,399,208 | 8/1983 | Takasu et al. | 430/59 |
| 4,489,147 | 12/1984 | Chang | 430/58 |
| 4,555,463 | 11/1985 | Hor et al. | 430/59 |
| 4,762,760 | 8/1988 | Wiedemann et al. | 430/59 |
| 4,780,385 | 10/1988 | Wieloch et al. | 430/58 |
| 4,786,570 | 11/1988 | Yu et al. | 430/58 |
| 5,032,481 | 7/1991 | Berwick et al. | 430/60 |
| 5,096,795 | 3/1992 | Yu | 430/59 |

*Primary Examiner*—John Goodrow

[57] ABSTRACT

An electrophotographic imaging with Po member including a supporting substrate having an electrically conductive surface, an optional charge blocking layer, a polyester adhesive layer, a polycarbonate adhesive layer, a charge generating layer, and a charge transport layer.

13 Claims, No Drawings

ELECTROPHOTOGRAPHIC IMAGING MEMBER WITH POLYESTER ADHESIVE LAYER AND POLYCARBONATE ADHESIVE LAYER COMBINATION

BACKGROUND OF THE INVENTION

This invention relates in general to an electrophotographic imaging member and more specifically, to an electrophotographic imaging member having an improved combination of adhesive layers.

One common type of electrophotographic imaging member is a multilayered photoreceptor. Multilayered photoreceptors member is a comprise a substrate, an electrically conductive layer, a hole blocking layer, an adhesive layer, a charge generating layer, and a charge transport layer. In web type embodiments, an anti-curl backing layer is often utilized. Multilayered photoreceptors may comprise a charge generating layer comprising finely divided particles of a photoconductive inorganic compound dispersed in an electrically insulating organic resin binder or a homogeneous material such as a vapor deposited compound. U.S. Pat. No. 4,265,990 discloses a layered photoreceptor having separate charge generating (photogenerating) and charge transport layers. The charge generating layer is capable of photogenerating holes and injecting the photogenerated holes into the charge transport layer.

Although excellent toner images may be obtained with multilayered photoreceptors, it has been found that as more advanced, higher speed electrophotographic copiers, duplicators, and printers were developed, longer life was needed for extended photoreceptor cycling. This was particularly desirable for flexible belt type photoreceptors in compact imaging machines that employ small diameter support rollers for photoreceptor belt systems operating in a very confined space. Small diameter support rollers are also highly desirable for simple, reliable copy paper stripping systems which utilize the beam strength of the copy paper to automatically remove copy paper sheets from the surface of a photoreceptor belt after toner image transfer. Unfortunately, small diameter rollers, e.g. less than about 0.75 inch (19 mm) diameter, raise the threshold of mechanical performance criteria to such a high level that photoreceptor belt seam failure can become unacceptable for multilayered belt photoreceptors. Poor adhesion between the charge generating layer and the underlying adhesive layer can cause craking or delamination at the welded seam. In addition, collisions between the belt photoreceptor seam and cleaning blades during imaging cycling can accelerate belt failure. Moreover, cracks in the seam tend to accumulate toner particles which are eventually expelled from the seam cracks during cycling and float to and deposit on critical components of the electrophotographic imaging system such lenses and corotron wires. Thus, in advanced imaging systems utilizing multilayered belt photoreceptors, belt failure has been encountered during belt cycling over small diameter rollers and/or during repeated contact with cleaning blades.

In addition, poor adhesion between the charge generating layer and the underlying adhesive layer can require undesirably complex coating procedures for production runs of photoreceptor belts. Thus, for example where wide belts are coated and thereafter slit lengthwise after coating delamination during slitting requires that deposition of the charge generation layer be prevented in regions to be slit to prevent cracking or delamination during or after slitting.

While the above described imaging members exhibit desirable electrical characteristics, there is an urgent need to extend life under extended image cycling conditions. It is also important that any solution employed to improve cycling life does not produce any deleterious effects on the electrical properties and mechanical integrity of the original device.

Thus, there is a continuing need for an electrophotographic .maging member having improved cycling life.

INFORMATION DISCLOSURE STATEMENT

U.S. Pat. No. 5,032,481 to Berwick et al., issued Jul. 16, 1991—An interlayer for a photoconductor element is disclosed comprising a mixture of at least one polyester and at least one polycarbonate which is interposed between an electrically conductive layer and a charge generation layer. The interlayer provides adhesion between the conductive layer and the charge generation layer.

U.S. Pat. No. 4,786,570 to Yu et al., issued Nov. 22, 1988—An electrophotographic imaging member is disclosed comprising a substrate having a conductive surface, a silane reaction product blocking layer, a polyester adhesive layer, a charge generation layer and a diamine hole transport layer.

U.S. Pat. No. 4,489,147 to Change, issued Dec. 18, 1984—An organic photoconductive element is disclosed comprising an electroconductive plastic film support, a bonding layer of an adhesive material on the support, a charge generating layer adhered to the bonding layer, and a charge transport layer. The adhesive bonding layer may comprise a polycarbonate resin (e.g. see column 3, lines 17–42).

U.S. Pat. No. 4,399,208 to Takasu et al., issued Aug. 16, 1983—An electrophotographic photosensitive member comprising a conductive support, an intermediate layer on the conductive support, a charge generating layer on the intermediate layer, and a charge transport layer. The intermediate layer may act as a bond layer to adhere to both the support and a photosensitive layer (e.g. see column 29, lines 24–30). The material which may be used for the intermediate layer may include polyester resins, polycarbonate resins, etc.

U.S. Pat. No. 4,762,760 to Wiedemann et al., issued Aug. 9, 1988—An electrophotographic recording material is disclosed comprising an electrically conducting film base and a photoconductive film. The photoconductive film is comprised of a charge-generating layer, a charge transport layer and an adhesion promoting insulating intermediate layer between the film base and the photocoductive film. The adhesion promoting insulating intermediate layer may act as a barrier layer, and serves to improve adhesion (e.g. see column 4, lines 19–23). Various natural or synthetic resin binders can be used for the intermediate layer such as polyester resins, polycarbonates, etc. (e.g. see column 4, lines 24–34).

U.S. Pat. No. 4,780,385 to Wieloch et al., issued Oct. 25, 1988—An electrophotographic imaging member is disclosed comprising a metal ground plane layer, a hole blocking layer, a charge generation layer, and a hole transport layer. An intermediate layer may be included between the blocking layer and the generator layer which can be used as an adhesive layer or a barrier layer. The materials for the intermediate layer may be a film-forming polymer such as polyester, polycarbonates, etc. (e.g. see column 13, lines 13-16).

U.S. Pat. No. 4,555,463 to Nor et al., issued Nov. 26, 1985—A photoresponsive imaging member is disclosed comprising a supporting substrate, an adhesive layer, a photogenerating pigment in contact with the adhesive layer, and a hole transport layer. The adhesive layer may comprise various materials which may include polyesters, polycarbonates, and other similar substances.

SUMMARY OF THE INVENTION

It is, therefore, an object of the present invention to provide an improved electrophotographic imaging member which overcomes the above-noted deficiencies.

It is yet another object of the present invention to provide an improved electrophotographic imaging member with longer cycling life.

It is still another object of the present invention to provide an improved electrophotographic imaging member which exhibits greater resistance to layer delamination.

It is also an object of the present invention to provide an improved electrophotographic imaging member which overcomes the problems of the prior art.

The foregoing objects and others are accomplished in accordance with this invention by providing an electrophotographic imaging member comprising a supporting substrate having an electrically conductive surface, a charge blocking layer, a polyester adhesive layer, a polycarbonate adhesive layer, a charge generating layer, and a charge transport layer.

Electrophotographic imaging members, including flexible electrostatographic belt imaging members, are well known in the art. These imaging member may be prepared by various suitable techniques. Typically, a substrate is provided having an electrically conductive surface and at least one photoconductive layer is then applied to the electrically conductive surface. A charge blocking layer may be applied to the electrically conductive surface prior to the application of the photoconductive layer. Adhesive is utilized between the charge blocking layer and the photoconductive layer. For multilayered photoreceptors, a charge generation binder layer is usually applied onto the blocking layer and a charge transport layer is formed on the charge generation layer.

The substrate may be opaque or substantially transparent and may comprise numerous suitable materials having the required mechanical properties. Accordingly, the substrate may be rigid or flexible and comprise a layer of an electrically, non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be flexible and in the form of an endless flexible belt. Preferably, the endless flexible belt shaped substrate comprises a commercially available biaxially oriented polyester known as Mylar, available from E. I. du Pont de Nemours & Co. or Melinex available from ICI.

The thickness of the substrate layer depends on numerous factors, including beam strength and economical considerations, and thus this layer for a flexible belt may be of substantial thickness, for example, about 125 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical coating techniques include sputtering, magnetron sputtering, RF sputtering, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. A typical electrical conductivity for conductive layers for electrophotographic imaging members in slow speed copiers is about $10^2$ to $10^3$ ohms/square.

After formation of an electrically conductive surface, a hole blocking layer is applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness between about 0.03 micrometer and about 0.06 micrometer is preferred for hole blocking layers for optimum electrical behavior.

Adhesive layers containing a polyester resin have been described in the prior art. However, the adhesive material in the electrophotographic imaging member of this inventions comprises a combination of a polyester layer and a polycarbonate layer. In other words, the adhesive material used in the electrophotographic imaging members of this invention comprises two different layers, a polyester resin layer on the charge blocking layer carried by the conductive surface of the substrate and a polycarbonate resin layer overlying and contiguous with the polyester layer. Any suitable film forming polyester may be utilized in the polyester adhesive layer. Typical film forming polyesters include, for example, duPont 49,000 (available from E.I. duPont de Nemours and Company), Vitel PE-100 (available from Goodyear Tire & Rubber), Vitel PE-200 (available from Goodyear Tire & Rubber) Vitel PE-200D (available from Goodyear Tire & Rubber), and Vitel PE-222 (available from Goodyear Tire & Rubber) and the like. The du Pont 49,000 (available from duPont de Nemours & Co.) polyester is a linear saturated copolyester reaction product of four diacids and ethylene glycol. The molecular structure of this linear saturated copolyester is represented by the following:

$$\overset{O}{\overset{\|}{HOC}}\text{-[diacid-diol]}_n\text{-OH}$$

where the mole ratio of diacid of ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. The du Pont 49,000 linear saturated copolyester consists of alternating monomer units of ethylene glycol and four randomly sequenced diacids in the above indicated ratio and has a weight average molecular weight of about 70,000 and a $T_g$ of about 32° C. Another polyester that may be used in the adhesive layer of this invention has the following structural formula:

$$\overset{O}{\overset{\|}{HOC}}\text{-[diacid-diol]}_n\text{-OH}$$

wherein the diacid is selected from the group consisting of terephthalic acid, isophthalic acid, and mixtures thereof, the diol is selected from the group consisting of ethylene glycol, 2,2-dimethyl propane diol and mixtures thereof, the ratio of diacid to diol is 1:1, n is a number between about 175 and about 350 and the $T_g$ of the copolyester resin is between about 50° C. about 80° C.

Another example of a polyester resin that may be employed in the polyester adhesive layer of this invention is a copolyester available from Goodyear Tire & Rubber Co. as Vitel PE-100. This polyester resin is a linear saturated copolyester of two diacids and ethylene glycol. The molecular structure of this linear saturated copolyester is represented by the following:

$$\overset{O}{\overset{\|}{HOC}}\text{-[diacid-ethylene glycol]}_n\text{-OH}$$

where the ratio of diacid to ethylene glycol in the copolyester is 1:1. The diacids are terephthalic acid and isophthalic acid. The ratio of terephthalic acid to isophthalic acid is 3:2. The molecular structures of these acids and ethylene glycol are present above. The Vitel PE-100 linear saturated copolyester consists of alternating monomer units of ethylene glycol and two randomly sequenced diacids in the above indicated ratio and has a molecular weight of about 50,000 and a $T_g$ of about 71° C.

Still another polyester resin for the polyester adhesive layer of this invention is available from Goodyear Tire & Rubber Co. as Vitel PE-200. This polyester resin is a linear saturated copolyester of two diacids and two diols. The molecular structure of this linear saturated copolyester is represented by the following:

$$\overset{O}{\overset{\|}{HOC}}\text{-[diacid-diol]}_n\text{-OH}$$

where the ratio of diacid to ethylene glycol in the copolyester is 1:1. The diacids are terephthalic acid and isophthalic acid. The ratio of terephthalic acid to isophthalic acid is 1.2:1. The molecular structures of these acids and ethylene glycol are presented above. The two diols are ethylene glycol and 2,2-dimethyl propane diol. The ratio of ethylene glycol to dimethyl propane diol is 1.33:1. The Goodyear PE-200 linear saturated copolyester consists of randomly alternating monomer units of the two diacids and the two diols in the above indicated ratio and has a molecular weight of about 45,000 and a $T_g$ of about 67° C.

The diacids from which the polyester resins for the adhesive layer this invention may be derived from terephthalic and isophthalic acids. However, any suitable film forming polyester may be utilized that satisfies the objects of this invention. The diols from which the polyester resins of this invention can be derived include ethylene glycol. Other glycols such as 2,2-dimethyl propane diol may also be employed in combination with ethylene glycol to prepare the polyester resins for the polyester adhesive layer of this invention.

The polyester adhesive layers of this invention should preferably comprise at least about 90 percent by weight of a polyester film forming polymer, based on the total weight of the polyester adhesive layer. The polyester adhesive layer comprising the polyester resin is applied to the charge blocking layer. The polyester adhesive layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the adhesive layer is preferably applied in the form of a dilute solution, with the solvent being removed after deposition of the coating by conventional techniques such as by vacuum, heating and the like. Generally, a weight ratio of polyester adhesive layer material and solvent of between about 0.05:100 and about 0.5:100 is satisfactory for spray coating. Any suitable solvent or solvent mixtures may be employed to form a coating solution of the polyester. Typical solvents include tetrahydrofuran, toluene, methylene chloride, cyclohexanone, and the like, and mixtures thereof. Generally, to achieve a continuous adhesive layer thickness of about 900 angstroms or less by gravure coating techniques, the solids concentration is preferably between about 2 percent and about 5 percent by weight based on the total weight of the coating mixture of polyester and solvent. However, any other suitable and conventional technique may be utilized to mix and thereafter apply the polyester adhesive layer coating mixture of this invention to the charge blocking layer. Drying of the deposited coating may be effected by any suitable conventional technique such as oven drying, infra red radiation drying, air drying and the like.

The polyester adhesive layer of this invention should be continuous. Satisfactory results may be achieved when the polyester adhesive layer has a dry thickness between about 50 Angstroms and about 2000 Angstroms. Preferably, the polyester adhesive layer has a thickness between about 200 Angstroms and 1000 Angstroms. Optimum results are achieved when the polyester adhesive layer has a thickness between about 400 Angstroms and 600 Angstroms. A polyester adhesive layer thickness greater than about 2000 Angstroms may lead to undesirably high residual voltage. When the thickness is less than about 50 Angstroms, poor adhesion of the charge generating layer to the blocking layer may occur.

The polycarbonate adhesive layers of this invention should be continuous and preferably comprises at least about 90 percent by weight of a polycarbonate forming polymer, based on the total weight of the polycarbonate adhesive layer. Any suitable film forming polycarbonate may be utilized in the polycarbonate adhesive layer. Typical film forming polycarbonates include, for example, poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G.; and a polycarbonate resin having a molecular weight of from about 20,000 to about 50,000 available as Merlon from Mobay Chemical Company. Other typical polycarbonate resins are described in U.S. Pat. No. 4,637,971, the entire disclosure thereof being incorporated herein by reference. Methylene chloride solvent is a desirable component of the polycarbonate layer coating mixture for adequate dissolving of all the components and for its low boiling point. However, any other suitable solvent may be substituted for methylene chloride. Other typical solvents include, for example, 1,1,2-trichloroethane, 1,2-dichloroethane, tetrahydrofuran, cyclohexanone, toluene and the like. Generally, the polycarbonate resins for the adhesive layer have a weight average molecular weight of from about 10,000 to about 150,000, more preferably from about 20,000 to about 120,000. The polycarbonate adhesive layer may be applied to the polyester adhesive layer by any suitable coating technique. Typical coating techniques include, for example, extrusion, gravure, spraying, doctor blade, wire wound rod, and the like. Drying of the deposited coating may be effected by any suitable conventional technique such as oven drying, infra red radiation drying, air drying and the like. Satisfactory result may achieved when the polycarbonate adhesive layer has a thickness between about 50 Angstroms and about 5000 Angstroms. A preferred polycarbonate adhesive layer thickness is between about 200 Angstroms and 1000 Angstroms. Optimum results are achieved when the polycarbonate adhesive layer has a thickness between about 400 Angstroms and 600 Angstroms. A polycarbonate adhesive layer thicker than about 2000 Angstroms, may lead to undesirably high residual voltage. When the thickness is less than about 50 Angstroms, poor adhesion of the charge generating layer to the adhesive layer may occur.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Any suitable polymeric film forming binder material may be employed as the matrix in the photogenerating binder layer. Typical polymeric film forming materials include those described, for example, in U.S. Pat. No.

3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

Instead of using photoconductive pigments dispersed in a film forming binder to form a charge generating layer, a continuous, thin photogenerating layer may be formed on the polycarbonate adhesive layer by vapor deposition. Examples of materials for vapor deposition of photogenerating layers include photoconductive perylene and phthalocyanine pigments, for example, benzimidazole perylene and chloroindium phthalocyanine. Other typical phthalocyanine pigments include the X-form of metal free phthalocyanine described in U.S. Pat. No. 3,357,989, and metal phthalocyanines in the form of vanadyl phthalocyanine, titanyl phthalocyanine and copper phthalocyanine. Other pigments of interest include, for example, dibromoanthanthrone; squarylium; quinacridones such as those available from du Pont under the tradename Monastral Red, Monastral Violet and Monastral Red Y; dibromo anthanthrone pigments such as those available under the trade names Vat Orange 1 and Vat Orange 3; substituted 2,4-diamino-triazines disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like. Use of a vapor deposition process such as vacuum sublimation deposition process is well known in the art and is especially desirable to obtain a thin charge generating layer without the need of a polymer binder. Generally, the charge generating material is heated to a temperature sufficient to vaporize it. A vacuum may be utilized to facilitate vaporization and, depending upon the material utilized, prevent decomposition. The substrate to be coated is maintained at a temperature below the condensation temperature of the charge generating material vapors. A typical technique for vapor deposition of charge generating layers is disclosed, for example, in U.S. Pat. No. 4,587,189, the entire disclosure thereof being incorporated herein by reference. Thin charge generating layers are desirable because they permit intimate pigment-to-pigment contact and provide a shorter charge carrier traveling path to reach the charge transport layer for efficient electrophotographic imaging process enhancement. Photogenerating layers containing vacuum deposited photoconductive compositions generally range in thickness of from about 0.1 micrometer to about 5 micrometers, and preferably have a thickness of from about 0.2 micrometer to about 3 micrometers. An optimum thickness between about 0.3 and about 1 micrometers gives best results. Thicknesses outside these ranges can be selected providing the objectives of the present invention are achieved. Other suitable photogenerating materials known in the art and which can be vapor, solution or otherwise deposited may also be utilized, if desired.

The charge transport layer may comprise any suitable solvent soluble organic polymer or non-polymeric material capable of supporting the injection of photogenerated holes and electrons from the charge generating layer and allowing the transport of these holes or electrons through the charge transport layer to selectively discharge the surface charge. The charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It comprises a substantially non-photoconductive material which supports the injection of photogenerated holes from the charge-generating layer. The charge transport layer is normally transparent when exposure is effected therethrough to ensure that most of the incident radiation is utilized by the underlying charge-generating layer. When used with a transparent substrate, imagewise exposure or erase may be accomplished through the substrate with all light passing through the substrate. In this case, the charge transport layer material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise activating compounds useful as an additive dispersed in electrically inactive polymeric materials making these materials electrically active. These compounds may be added to solvent soluble polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble. Aromatic amine compounds for charge transport layers are well known in the art. Typical aromatic amine compounds for charge transport layers include, for example, triphenylmethane, bis(4-diethylamine-2-methylphenyl)-phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis)chlorophenyl)-[1,1'-biphenyl]-4,4'-diamine, N,N'-diphenyl-N,N'-bis(3''-methylphenyl)-(1,1'-biphenyl)-4,4'-diamine, the like dispersed in an inactive resin binder.

Any suitable inactive resin binder soluble in methylene chloride or other suitable solvents may be employed in the process of this invention even though the solvent used for charge transport layer coating solution can attack the adhesive layer underlying the charge generating layer. Typical inactive resin binders soluble in methylene chloride include polycarbonate resin, polyester, polyarylate, polyacrylate, polyether, polysulfone, and the like. Molecular weights can vary from about 20,000 to about 150,000. Other solvents that may dissolve these charge transport layer binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan TM 145 from General Electric Company; poly(4,4'-isopropylidene-diphenylene carbonate) with a molecular weight of from about 40,000 to about 45,000, available as Lexan TM 141 from General Electric Company; a polycarbonate resin having a molecular weight of from about 50,000 to about 100,000, available as Makrolon TM, from Farbenfabricken Bayer A. G.; a polycarbonate resin having a molecular weight of from about 20,000 to about 50,000, available as Merlon TM from Mobay Chemical Company; polyether carbonates; and 4,4'-cyclohexylidene diphenyl polycarbonate. Methylene chloride is the preferred solvent for most charge transport layer coating solutions because it adequately dissolves all the coating material components and because it has a low boiling point which enhances wet coating drying after application over the charge generating layer. The adhesive layer material underlying the charge generating layer is soluble in and subject to attack by the charge transport coating composition solvent (e.g. methylene chloride) during application of the charge transport layer coating composition. Still other inactive resin binders soluble in methylene chloride or other suitable solvent may be employed in the process of this invention. Additional typical inactive resin binders soluble in methylene chloride include polyvinylcarbazole, polyester, polyarylate, polyacrylate, polyether, polysulfone, and the like. Molecular weights can vary from about 20,000 to about 150,000.

If desired, a charge transport layer may comprise electrically active resin materials instead of or mixed with inactive resin materials. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532. Polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(p-tolylmethyl silylene), poly(cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as Described in U.S. Pat. No. 3,870,516. The disclosures of each of the patents identified above pertaining to binders having charge transport capabilities are incorporated herein by reference in their entirety.

Any suitable and conventional technique may be utilized to mix and thereafter apply the charge transport layer coating mixture to the charge generating layer. Typical application techniques include spraying, dip coating, roll coating, wire wound rod coating, and the like. The charge transport layer is applied to the charge generating layer after the substrate carrying the charge generating layer has been cooled. Drying of the deposited coating may be effected by any suitable conventional technique such as oven drying, infra red radiation drying, air drying and the like.

The thickness of the charge transport layer may be between about 10 micrometers and about 50 micrometers, and preferably from about 20 micrometers to about 35 micrometers, but thicknesses outside this range can also be used. Optimum thickness is between about 23 micrometers and about 31 micrometers.

Examples of photosensitive members having at least two electrically operative layers include the charge generator layer and diamine containing transport layer members are disclosed, for example, in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A control photoconductive imaging member was prepared by providing a web of titanium coated polyester (Melinex, available from ICI Americas Inc.) substrate having a thickness of 3 mils, and applying thereto, with a gravure applicator, a solution containing 50 grams 3-aminopropyltriethoxysilane, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 0.05 micrometer.

An adhesive interface layer was then prepared by the applying a wet coating over the blocking layer, using a gravure applicator, containing 0.5 percent by weight based on the total weight of the solution of copolyester adhesive (du Pont 49,000, available from E. I. du Pont de Nemours & Co.) in a 70:30 volume ratio mixture of tetrahydrofuran/cyclohexanone. The adhesive interface layer was then dried for about 5 minutes at 135° C. in the forced air drier of the coater. The resulting adhesive interface layer had a dry thickness of 620 Angstroms.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 0.8 gram polyvinyl carbazole and 14 ml of a 1:1 volume ratio of a mixture of tetrahydrofuran and toluene into a 2 oz. amber bottle. To this solution was added 0.8 gram of trigonal selenium and 100 grams of ⅛ inch diameter stainless steel shot. This mixture was then placed on a ball mill for 72 to 96 hours. Subsequently, 5 grams of the resulting slurry were added to a solution of 0.36 gm of polyvinyl carbazole and 0.20 gm of N,N'-diphenyl-N,N'-bis(3-methylphenyl)-1,1'-biphenyl-4,4'-diamine in 7.5 ml of 1:1 volume ratio of tetrahydrofuran/toluene. This slurry was then placed on a shaker for 10 minutes. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 2 micrometers.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbenfabriken Bayer A. G. The resulting mixture was dissolved in methylene chloride to form a solution containing 15 percent by weight solids. This solution was applied on the photogenerator layer using a Bird applicator to form a coating which upon drying had a thickness of 24 microns. During this coating process the humidity was equal to or less than 15 percent. The resulting photoreceptor device containing all of the above layers was annealed at 135° C. in a forced air oven for 15 minutes and thereafter cooled to ambient room temperature.

After application of the charge transport layer coating, an anti-curl coating was applied. The anti-curl coating solution was prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle was then covered tightly and placed on a roll mill for about 24 hours until total dissolution of the polycarbonate and the copolyester is achieved. The anti-curl coating solution thus obtained was applied to the rear surface of the supporting substrate (the side opposite to the imaging layers) of the photoreceptor device by hand coating using a 3 mil gap Bird applicator. The coated wet film was dried at 135° C. in an air circulation oven for 5 minutes to produce a dry, 14 micrometers thick anti-curl layer.

EXAMPLE II

The process of Example I was repeated with the same materials and quantities except that after formation of the polyester adhesive layer and prior to application of the photogenerator layer, a polycarbonate adhesive layer was applied. The polycarbonate adhesive interface layer was applied as a wet coating over the polyester adhesive layer, using a Bird applicator, containing 0.5 percent by weight based on the total weight of the solution of polycarbonate adhesive (Makrolon 5705, available from Bayer AG) in methylene chloride. The adhesive interface layer was then dried for about 5 minutes at 135° C. in the forced air drier of the coater. The resulting adhesive interface layer had a dry thickness of 500 Angstroms.

EXAMPLE III

The process of Example I was repeated with the same materials and quantities except that another polyester (Vitel PE-100, available from Goodyear Tire & Rubber Co.) was substituted for the du Pont 49,000 polyester in the polyester adhesive layer. After drying, the polyester adhesive interface layer had a dry thickness of 620 Angstroms.

EXAMPLE IV

The process of Example III was repeated with the same materials and quantities except that after formation of the polyester adhesive layer and prior to application of the photogenerator layer, a polycarbonate adhesive layer was applied. The polycarbonate adhesive interface layer was applied as a wet coating over the blocking layer, using a gravure applicator, containing 0.5 percent by weight based on the total weight of the solution of polycarbonate adhesive (Makrolon 5705, available from Bayer AG) in methylene chloride. The adhesive interface layer was then dried for about 5 minutes at 135° C. in the forced air drier of the coater. The resulting adhesive interface layer had a dry thickness of 500 Angstroms.

EXAMPLE V

The photoconductive imaging members of Examples I through IV were evaluated for adhesion by reverse peel measurements to determine the bond strengths of the coating layers. An Instron Tensile Tester, Model TM was used for the evaluation. The reverse peel measurement for the photoconductive imaging members was designed to determine the adhesion strength of the generating layer to the adhesion layer. Three 0.5 inch × 6 inch (1.27 cm × 15.24 cm) test samples, one near the center and each 1 inch (2.54 cm) from the edges across the width of the imaging member were cut from the imaging member. Each test sample was partially split between the interface layer and the generating layer with a razor blade and peel of the charge generating layer from the interface layer was initiated by hand to form a peeled segment approximately 3.5 inches (9 cm) long. The charge transport layer side of the test sample with the peel strip segment was pressed against a double sided tape on an aluminum backing plate. The lower edge of the charge transport layer was positioned evenly with the bottom of the plate. Each test sample with the backing plate was inserted into the jaws of the Instron Tensile Tester for the reverse peel measurement. The load range of an Instron chart recorder was set at 10 grams full scale for the reverse peel measurement. With the jaw crosshead speed at 1 inch/min (2.54 cm/min) and the chart speed at 2 inches/min (5.08 cm/min). The substrate was peeled at least 2 inches (5.08 cm).

| Example No. | Polyester Layer | Polycarbonate Layer | Reverse Peel (g/cm) |
|---|---|---|---|
| I | 49000 | None | 6.7 |
| II | 49000 | Makrolon | 84.3 |
| III | PE-100 | None | 12.9 |
| IV | PE-100 | Makrolon | 41.3 |

The peel strength improved 1,158 percent when the single polyester adhesive layer of Example I was replaced by the combination of the polyester adhesive layer and polycarbonate layer of Example II. Also, the peel strength improved 220 percent when the single polyester adhesive layer of Example III was replaced by the combination of the polyester adhesive layer and polycarbonate layer of Example IV.

EXAMPLE VI

The electrical properties of the photoconductive imaging members prepared according to Examples I, II, III and IV were tested at 21° C. and 40 percent relative humidity. These samples were charged with a DC corotron to a surface charge density of $1.2\times10^{-7}$ coulombs/sec$^2$. The dark development potential, $V_{DDP}$ was measured 0.6 second after charge using an electrostatic voltmeter with the samples kept in the dark. The background potential, $V_{BG}$, was determined by charging the sample to the same current density as above in the dark, exposing 0.16 second later with 3.8 ergs/cm$^2$ of white light restricted to the 400 nm to 700 nm spectral range and measuring the surface potential at 0.6 second after charge. Samples subjected to 10,000 cycles cyclic scanning testing at 30 inches per second gave substantially identical charge acceptance, dark decay rate, background and residual voltages, photoinduced discharge characteristics, and cycle-down for both photoconductive imaging members. These substantially identical results show that there was no detrimental effect due to the presence of the polycarbonate adhesive layer.

EXAMPLE VII

A control photoconductive imaging member was prepared by using the same procedures and same materials described in Example I except that the polyester adhesive layer was 600 Angstroms thick instead of 630 Angstroms and the procedures and materials used to fabricate the photogenerating layer described in Example I were replaced by the following: a benzimidazole perylene charge generating pigment was vacuum sublimation deposited over the du Pont 49,000 polyester adhesive layer from a heated crucible. The sublimation deposition process was carried out in a vacuum chamber under about $4\times10^{-5}$ mm Hg pressure and a crucible temperature of about 550° C. During vapor deposition, the deposited benzimidazole perylene layer was at an elevated temperature whereas the adhesive coated substrate was maintained below the condensation temperature of the benzimidazole perylene vapors until a 0.7 micrometer thick benzimidazole perylene layer was formed. After removal of the vacuum and cooling to ambient temperature, the benzimidazole perylene coated member was coated with the charge transport layer and anti-curl layer as described in Example I.

EXAMPLE VIII

The process of Example VII was repeated with the same materials and quantities except that a higher solids concentration of the du Pont 49,000 polyester adhesive coating composition was used to form a polyester adhesive layer having a thickness of 1200 Angstroms after drying.

EXAMPLE IX

The process of Example VIII was repeated with the same materials and quantities except that after formation of the polyester adhesive layer and prior to application of the photogenerator layer, a polycarbonate adhesive layer was applied. The polycarbonate adhesive interface layer was applied as a wet coating over the blocking layer, using a gravure applicator, containing 0.5 percent by weight based on the total weight of the solution of polycarbonate adhesive (Makrolon 5705, available from Bayer AG) in methylene chloride. The adhesive interface layer was then dried for about 5 minutes at 135° C. in the forced air drier of the coater. The resulting adhesive interface layer had a dry thickness of 600 Angstroms.

EXAMPLE X

The photoconductive imaging members of Examples VII through IX were evaluated for adhesion by reverse peel measurements to determine the bond strengths of the coating layers. The reverse peel test procedures were identical to that described in Example V. The results of the test are shown in the following table.

| Example No. | Polyester Layer | Polycarbonate Layer | Reverse Peel (g/cm) |
|---|---|---|---|
| VII | 49000 | None | 9.8 |
| VIII | 49000 | None | 32.2 |
| IX | 49000 | Makrolon | Would not Peel |

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate having an electrically conductive surface, an optional charge blocking layer, a polyester adhesive layer, a polycarbonate adhesive layer, a charge generating layer, and a charge transport layer.

2. An electrophotographic imaging member according to claim 1 wherein said polyester adhesive layer has a thickness between about 50 Angstroms and about 2000 Angstroms.

3. An electrophotographic imaging member according to claim 1 wherein said polyester adhesive layer has a thickness between about 200 Angstroms and 1000 Angstroms.

4. An electrophotographic imaging member according to claim 1 wherein said polyester adhesive layer has a thickness between about 400 Angstroms and 600 Angstroms.

5. An electrophotographic imaging member according to claim 1 wherein said polycarbonate adhesive layer has a thickness between about 50 Angstroms and about 2000 Angstroms.

6. An electrophotographic imaging member according to claim 1 wherein said polycarbonate adhesive layer has a thickness between about 200 Angstroms and 1000 Angstroms.

7. An electrophotographic imaging member according to claim 1 wherein said polycarbonate adhesive layer has a thickness between about 400 Angstroms and 600 Angstroms.

8. An electrophotographic imaging member according to claim 1 wherein said supporting substrate comprises a thin flexible web.

9. An electrophotographic imaging member according to claim 1 wherein said charge generator layer comprises a vapor deposited photoconductive material.

10. An electrophotographic imaging member according to claim 1 wherein said charge generator layer comprises photoconductive particles dispersed in a film forming binder.

11. An electrophotographic imaging members according to claim 1 wherein said charge transport layer comprises a film forming polycarbonate.

12. An electrophotographic imaging members according to claim 1 wherein said charge transport layer comprises an electrically active charge transporting polymer.

13. An electrophotographic imaging members according to claim 1 wherein said charge transport layer comprises an electrically inactive polymer and at least one charge transporting aromatic amine compound.

* * * * *